US005464223A

United States Patent [19]

Dermott

[11] Patent Number: 5,464,223

[45] Date of Patent: Nov. 7, 1995

[54] GOLF BALL TEEING DEVICE

[76] Inventor: John R. Dermott, Box 68, Cookstown, Ontario, Canada, L0L 1L0

[21] Appl. No.: 218,423

[22] Filed: Mar. 28, 1994

[51] Int. Cl.[6] ..... A63B 57/00

[52] U.S. Cl. ..... 273/201

[58] Field of Search ..... 273/207

[56] References Cited

U.S. PATENT DOCUMENTS

| | | | |
|---|---|---|---|
| 1,868,261 | 7/1932 | Spencer | 273/201 |
| 2,171,299 | 8/1939 | Beckett | 273/201 |
| 2,657,237 | 4/1954 | Willcox | 273/201 |
| 3,003,770 | 10/1961 | Jones | 273/201 |
| 3,127,177 | 3/1964 | Benkoe | 273/201 |
| 3,738,662 | 6/1973 | Hodgin | 273/201 |
| 4,265,453 | 5/1981 | Loof | 273/201 |
| 4,981,299 | 1/1991 | Petrillo | 273/201 |

FOREIGN PATENT DOCUMENTS

| | | | |
|---|---|---|---|
| 1501563 | 10/1967 | France | 273/201 |

*Primary Examiner*—V. Millin
*Assistant Examiner*—Steven B. Wong

[57] ABSTRACT

A device for teeing a golf ball automatically and in portable form. It is a complete unit consisting of a hopper for holding a plurality of balls, guides and blockers to prevent the balls clogging in the hopper, a rotor and pendulum to release one ball at a time, an automatic actuation of the ball release, a pivoting ramp to place a ball on an integral tee and a connection to the tee so that when the ball is struck with a golf club, the next ball will automatically proceed to the tee. The flow of a ball to the tee is accomplished by gravity due to the elevated hopper and the force of the golfer's swing. The device is mechanical and does not require electric power nor batteries and is completely automatic since no separate operation is required to send the ball to the tee.

5 Claims, 5 Drawing Sheets

GOLF BALL TEEING DEVICE

BACKGROUND OF THE INVENTION

This invention relates to a golf ball teeing device that is fully automatic and portable. The device is a complete self-contained unit consisting of a base, a hopper, tubes to transmit the ball to a tee, an automatic release of one ball at a time and a tee pad with an integral tee.

When a golfer is practicing hitting a golf ball, he may want to hit numerous balls at one practice session and the requirement to place a ball on a tee over and over again becomes tedious and in many cases a strain on the golfer's back. The purpose of this invention is to provide a device to make teeing of the golf ball easier and faster.

Prior art devices can be divided into two types. One type is where the device is partly or completely below ground level and accordingly permanently installed at driving ranges. The other type operates entirely above ground and can be portable. This device is concerned with the above ground portable type.

Golf has been played for over 500 years but even today a reliable and portable automatic golf tee is not available. One can visit hundreds of golf driving ranges, both indoor and outdoor, and not see one automatic tee in use. Looking in many leading monthly distributed national golf magazines, you will find advertising for every golf gimmick, accessory and training aid imaginable but you will not find any automatic golf tee advertised. There are very few automatic and portable golf tee devices on the market to-day and the problems associated with them over the years are numerous as follows:

- not completely automatic (you must make a separate motion to operate a lever or a switch to make the golf ball go to the tee before every drive).
- not easily portable (too heavy and cumbersome to move around frequently).
- actual tee is not included (the tee from which the ball is actually driven, is omitted and therefore you must place a tee in the ground yourself or place the device near a fixed tee at the driving range).
- electric power is required (the unit is more expensive and only useful in proximity to a power supply and can't be used on driving range grass areas).
- battery power is required (it is expensive to replace batteries and just when you want to use the unit, the batteries will likely be dead).
- actual tee support is fragile (after some use, the support holding the tee could be damaged since it is not likely protected from errant swings below the bottom of the ball).
- only a small quantity of balls can be placed in the unit (units are usually built only vertically and would be too high to carry around if they held approximately more than 50 balls).
- too complicated (parts are too numerous and of special construction to economically manufacture a unit for the consumer).
- balls clog in the hopper (the golfer will have to stop his practice to get the balls free and this may happen frequently at one practice).

Similar devices on the market to-day will likely have one or more of the previously described problems. The most prevalent problem is likely the clogging of the hopper. If golf balls come in contact with each other either from the side or directly on top and are against a fixed object such as a hopper wall or floor (even if they are sloped), the balls will clog due to their indentations wedging into each other. This is such a problem that most patents do not address it since they do not have a suitable solution and they just have a drawing showing a hopper outline but do not elaborate.

The device described herein overcomes all of the previously described problems and results in a reliable unit.

SUMMARY OF THE INVENTION

This invention is for a completely automatic and portable golf tee device which can be kept in a car trunk for use at a driving range or with a net can be used in a person's back yard, garage or basement. No electric power nor batteries are used. Balls are placed in the hopper and every time a ball is driven from the integral tee, another ball is automatically placed on the tee until the unit is deplete of balls. The unit weighs less than 10 pounds and is about 10 inches wide by 10 inches long (excluding the tee pad) and 17 inches high. It is basically constructed of rubber, aluminum and clear plastic.

Generally it is a golf ball teeing device comprising a base, a hopper for holding a plurality of balls, a means for transmitting the balls from the hopper to a tee, a means for releasing one ball at a time, a means for actuation of the ball release means, and an above ground thin tee pad with means for holding a rubber tee and for protecting the actuation means for the ball release means from damage by the golfer's swing. The device consists of an above ground small tee pad (about 8 inches square) and below the top surface of the pad is a small diameter rod upon which is securely mounted an ordinary rubber golf tee. With a ball on the tee, when the golfer swings hitting the tee and/or the golf ball with his golf club, the tee will bend rotating the rod on which it is mounted. A bolt fastened near the other end of the rod will accordingly be rotated and will hit a wire lever. This lever will oscillate a pendulum and the top of the pendulum in moving will let a rotor rotate 90 degrees which will let one ball run down a ramp. This ball falls into another ramp which will pivot due to the weight of the ball which lets the ball run down and onto a tee and ready for the next swing. After the ball drops out of the pivoting ramp, the ramp is returned to its near vertical position by a counterweight and ready to receive the next ball. The hopper, holding about 90 balls, is arranged in lanes preventing the golf balls from contacting each other from the side which would bring about clogging since the indentations on the balls would wedge them together. Each lane has a bottom floor and a top floor. Lane blockers are used in the hopper bottom floor so that balls cannot come out of a lane until the previous lane is empty and therefore will not clog. One-way swinging gates are used which only open toward the hopper exit and which prevent any balls being forced into empty lanes and also serving as guides toward the exit.

DESCRIPTION OF THE DRAWINGS

In drawings which illustrate embodiments of the invention.

Figure 1:
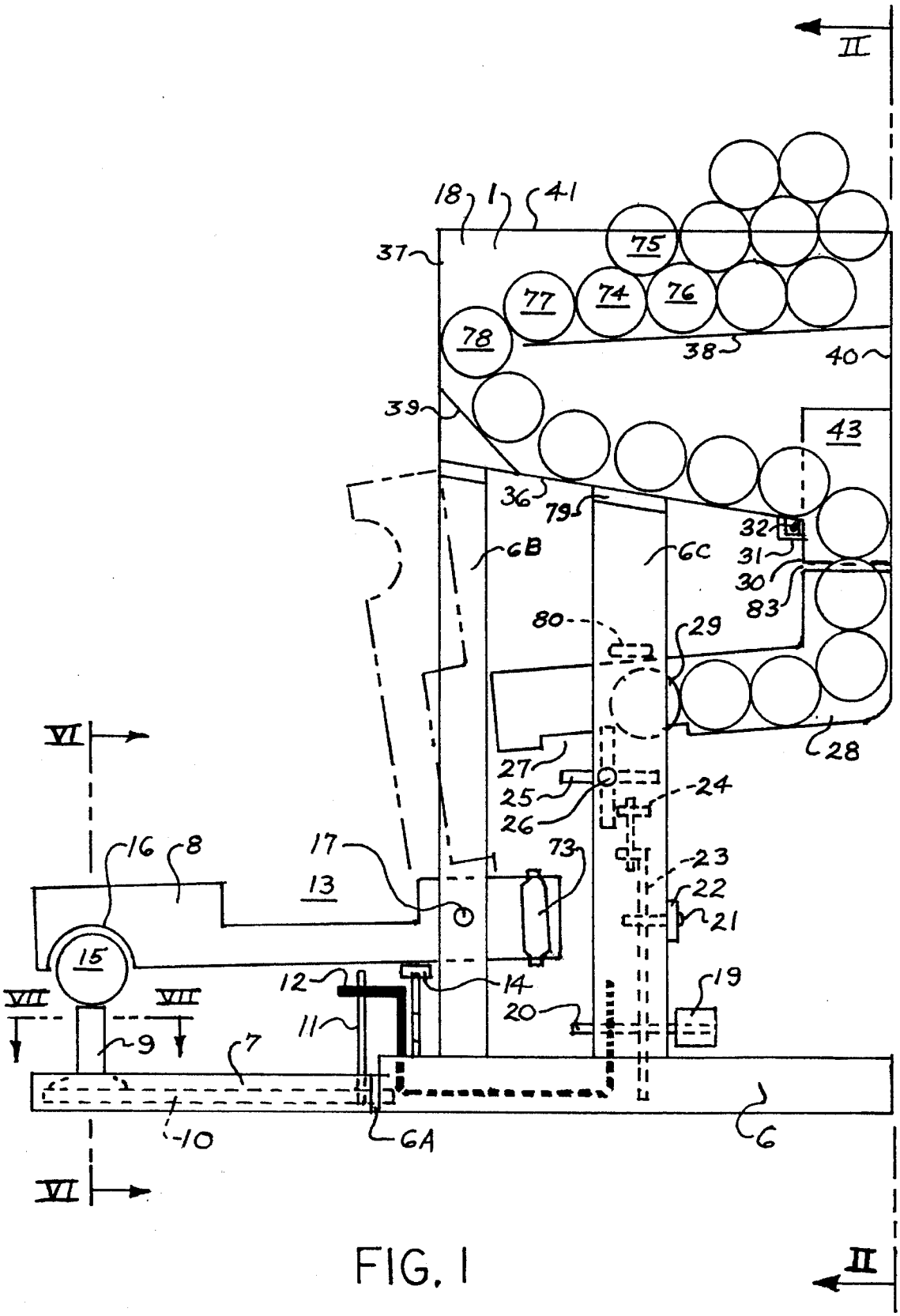
FIG. 1 is a side elevation showing the unit just placing a ball on the tee.

In the drawings, the pivoting ramp, stationary ramp and most parts of the hopper are constructed with 1/16 inch thick clear plastic and for clarity are just shown as a single line and naturally any solid parts behind the plastic, since they can be seen, appear as solid lines not dotted. Also the wire parts, the transfer lever & lane blockers are shown in thick single lines.

DESCRIPTION OF THE INVENTION

Figure 3:
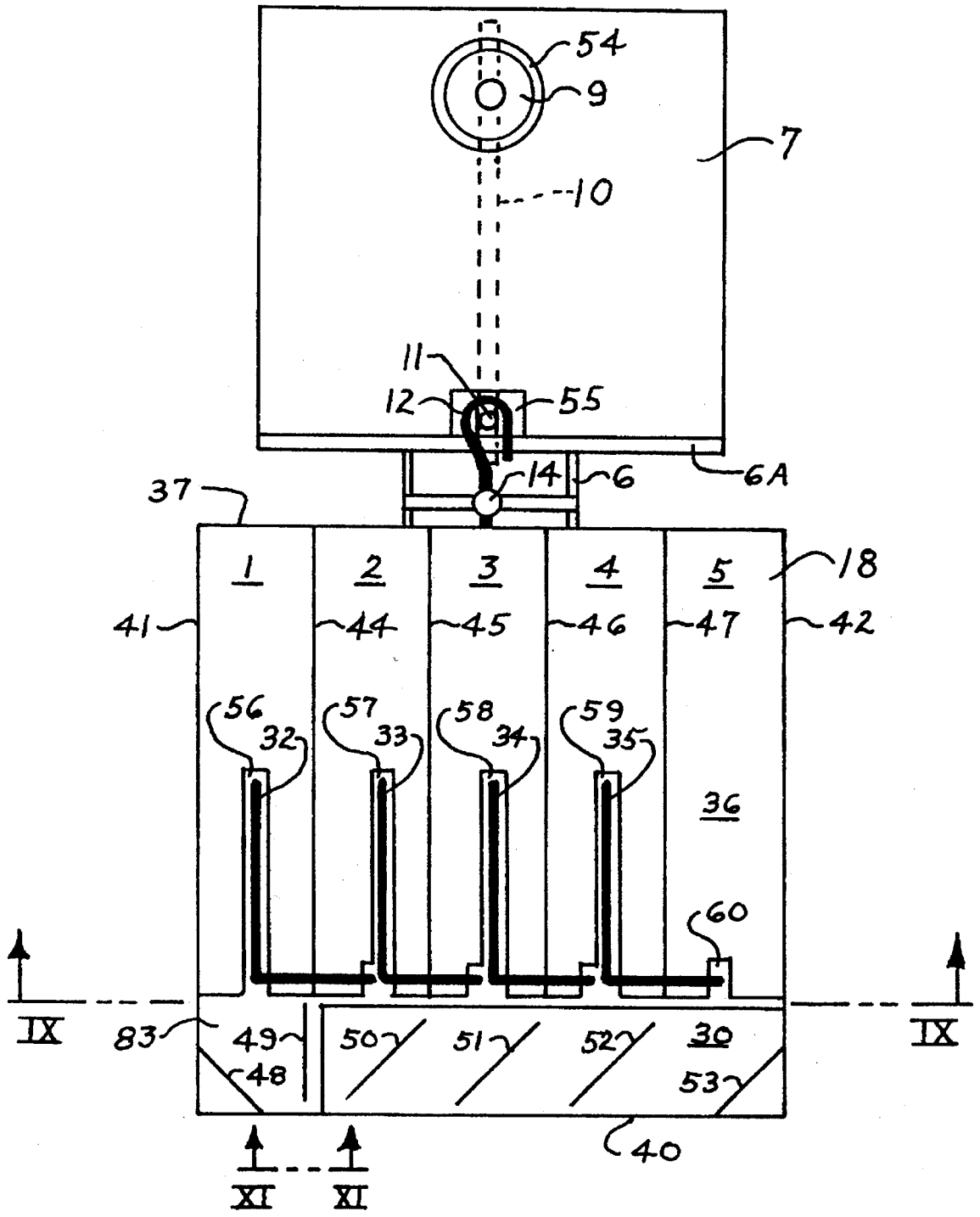
FIG. 3 is a plan view taken at section III—III showing the bottom floor of the hopper and the top surface of the tee pad. For clarity, the pivoting ramp and ball on the tee are left out of this view and also no balls are shown in the hopper.
Figure 4:
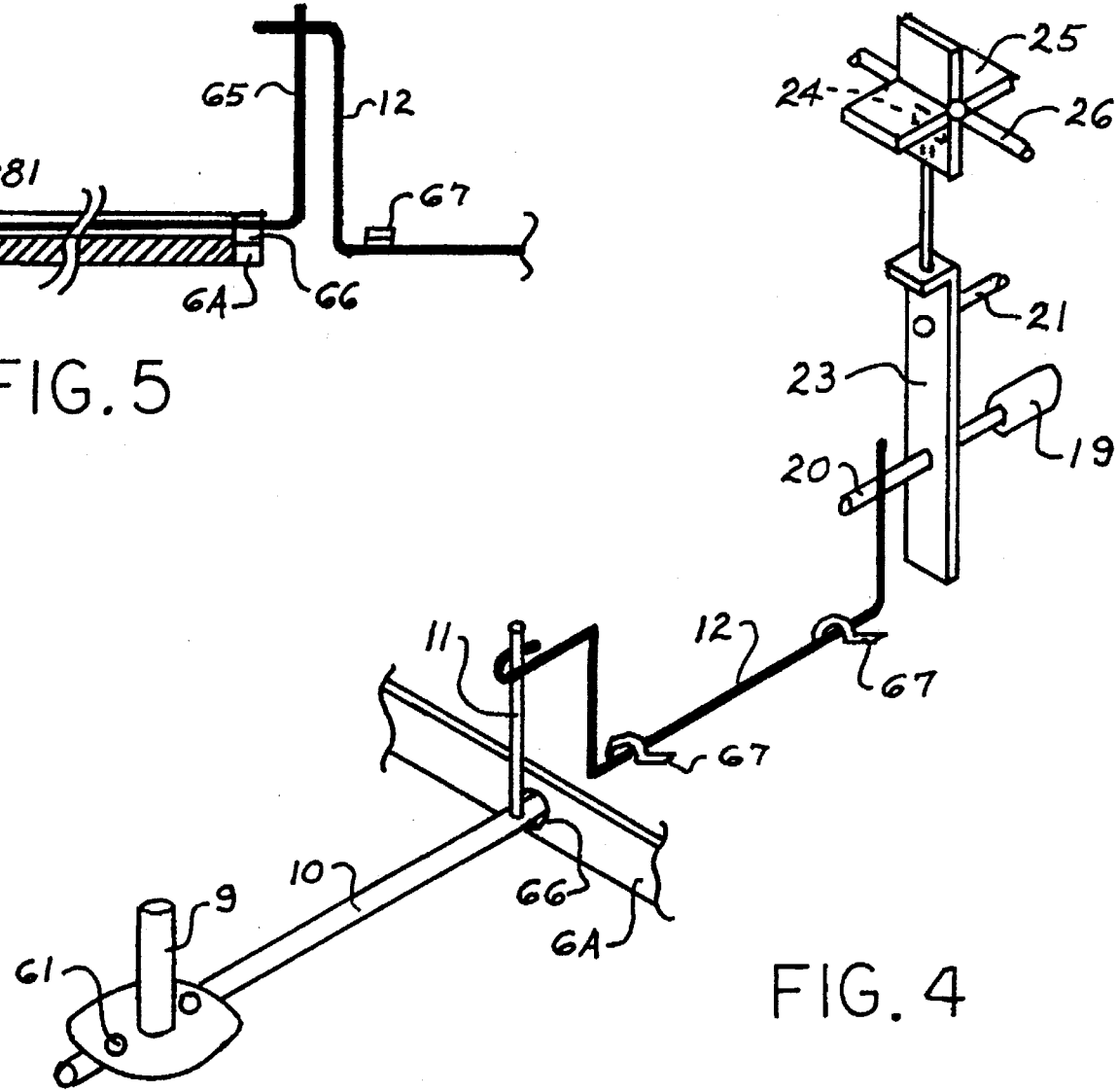
FIG. 4 is an oblique drawing only showing the means to release one ball at a time and the actuation means to release the ball.
Figure 6:
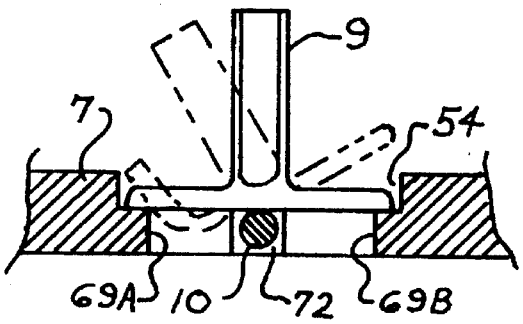
FIG. 6 is an elevation view taken at VI—VI showing the tee mounting arrangement but for clarity leaving out the ball and the pivoting ramp.
Figure 7:
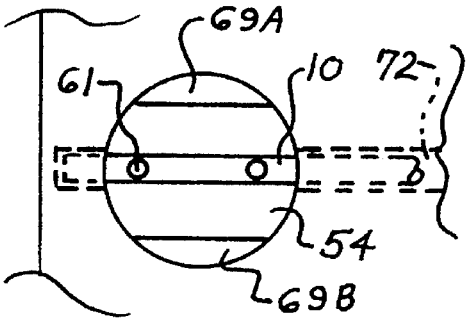
FIG. 7 is a plan view taken at VII—VII with the tee removed to show the top opening in the tee pad.

Referring to the drawings, the automatic golf tee device consists of an aluminum base 6 with two vertical projections 6B and two vertical projections 6C. Attached to the base via aluminum bar 6A is a rubber tee pad 7 about ½ inch thick. A small about ¼ inch diameter aluminum rod 10 is contained in a groove 72 (shown only in FIGS. 6 & 7) which extends from the bottom of the pad up to about half its thickness and nearly the complete length of the pad. In FIGS. 4 & 7, near one end of rod 10 is fastened, via two bolts 61, a rubber golf tee 9 having a hollow vertical stem and a flat base with two holes in its base for bolts 61. Steel bolt 11 is fastened near the other end of the rod and projects vertically up like the tee. In FIG. 3, opening 55 cut through pad 7 is required to avoid interference with bolt 11 when it rotates. Tee 9 sits in opening 54 (which is just slightly larger in diameter than the tee base) and sits on shoulders 69A & 69B as shown in FIGS. 6 & 7. One end of rod 10 sits loosely in opening 66 in bar 6A of the base as shown in FIG. 4. Tee 9, rod 10 and bolt 11 form a complete rotatable member. Whenever the tee is worn and has to be replaced, this complete member can be removed out the bottom of the tee pad by pushing the tee down forcing the base of the tee off the shoulders and then moving the member axially out of opening 66. A new tee is bolted onto the rod and the complete member is installed by reversing the removing operation.

A rotatable transfer lever 12, a heavy, one-piece, stiff wire sits in base 6 and is prevented from appreciably moving axially or vertically by two clips 67 fastened to the base as shown in FIG. 4. A vertical projection of lever 12 is bent in a loop so that it loosely wraps around bolt 11 which holds it in a vertical position. The other end of lever 12 has a vertical projection which rests against bolt 20 of a pendulum 23.

Figure 2:
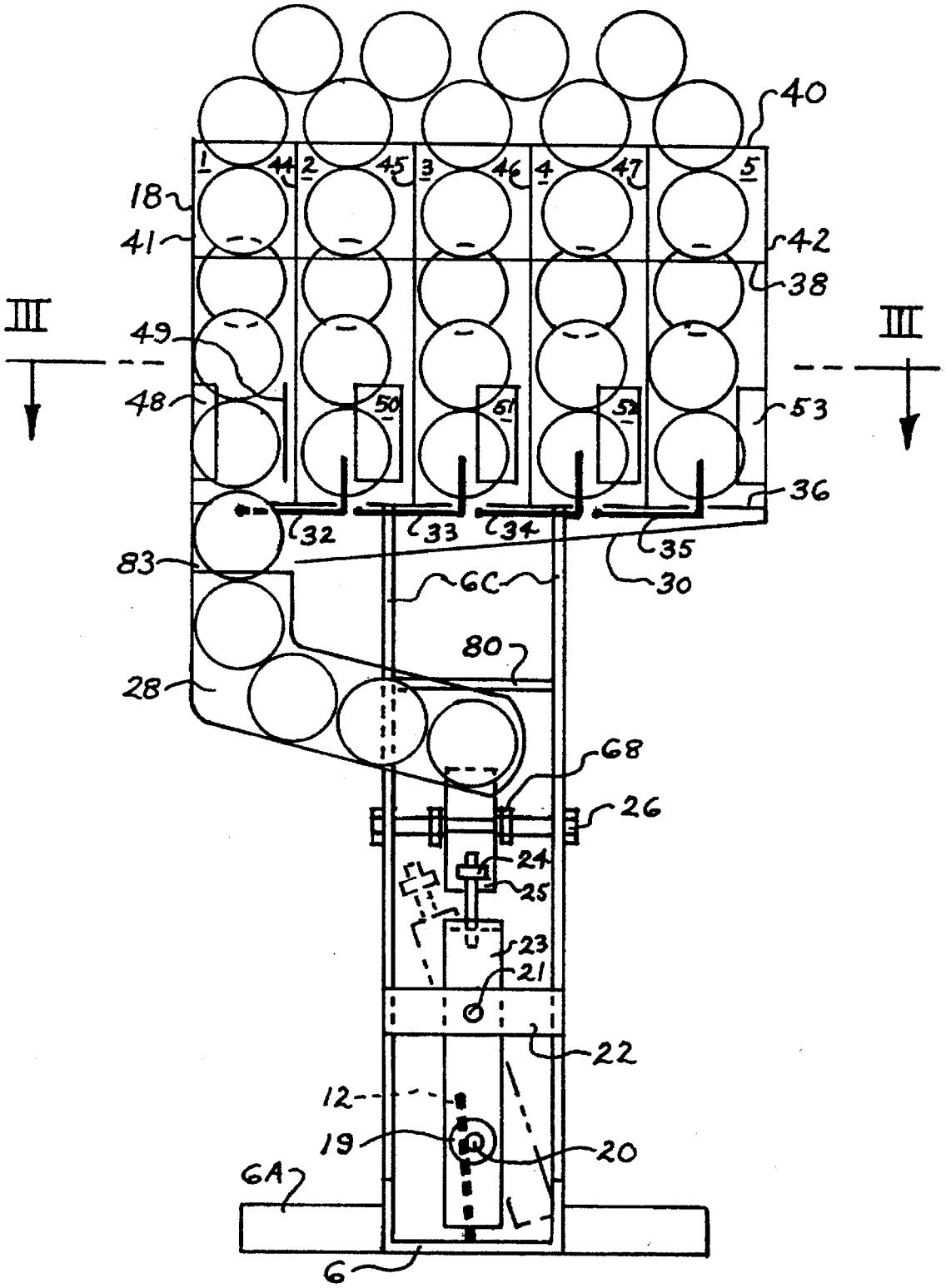
FIG. 2 is a hopper end elevation view taken along section II—II.

Pendulum 23 can oscillate by pivoting about bolt 21 which is secured to base 6C via bar 22 as seen in FIGS. 1 & 2. The bottom part of the pendulum below the pivot has a securely fastened bolt 20, one end of which has a counterweight 19 to normally maintain the pendulum in a vertical position and the other end contacts lever 12. Looking in from the tee end of the device as in FIG. 4, lever 12 is resting on the right side of bolt 20 and this is the set-up for use by a right-handed golfer. For a left-handed golfer, the lever 12 would be installed to rest on the left side of bolt 20 as viewed from the tee end of the device. The top part of the pendulum , above the pivot, has a small rubber wheel 24 which runs in the direction of the oscillation of the pendulum. This wheel 24 acts to cut down the friction between the pendulum and the rotor 25 and also helps to dampen the force of the rotor when it turns and is stopped by the pendulum.

The rotor 25, to release one ball at a time, is four bladed with the blades at 90 degrees to each other and is free running (free to rotate unless interfered with). The rotor rotates about bolt 26 which is fastened to base 6C as shown in FIG. 2 and the rotor is centered axially on bolt 26 by two fixed nuts 68 with just enough clearance between the nuts and rotor to allow the rotor to rotate. In FIG. 2, the pendulum is shown at rest and will interfere with the rotor and prevent it from turning. Whenever the pendulum is oscillated, it takes the alternate position shown in FIG. 2 and the wheel now does not interfere with the rotor allowing the rotor freedom to rotate. In FIG. 1, a clear plastic tube 28, about ¼ inch larger in diameter than a golf ball, is sloped to transmit balls from the hopper exit 83 and has a rectangular slot 27 in the bottom side just large enough to allow the rotor blades to rotate into it. The rotor blades project into slot 27 about ½ inch and will prevent a ball from rolling out of tube 28 which is stationary (one end of the tube is attached to wall 41 of the hopper and the other end is attached to base members 6C by bar 80).

In FIGS. 1 & 2, a clear plastic hopper 18 holds about 90 balls and consists of five lanes namely 1, 2, 3, 4, and 5 separated by internal partitions 44, 45, 46 and 47 to keep the balls in single file. The lanes are just slightly wider than a golf ball diameter. The hopper exterior is formed by bottom floor 36, front wall 37, back wall 40 and sides 41 and 42. Hopper exit ramp 30 slopes toward tube 28 entrance. Each lane has a bottom floor 36 sloped towards the hopper exit and a top floor 38 sloped in the other direction with clearance between the end of floor 38 and front wall 37 sufficient to allow a golf ball to exit to the bottom floor. Guide 39 is angled between the bottom floor and front wall so that balls will not wedge themselves into the corner. Guides 48 and 53 in FIGS. 2 and 3, serve a similar purpose. In FIG. 1, an opening 43 is in each partition to allow balls to run down exit ramp 30 from wall 42 to wall 41.

Figure 8:
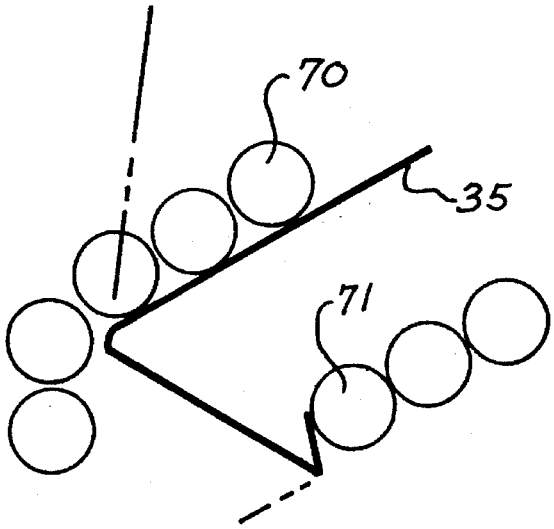
FIG. 8 is an oblique line drawing showing the theory of the lane blockers.
Figure 9:
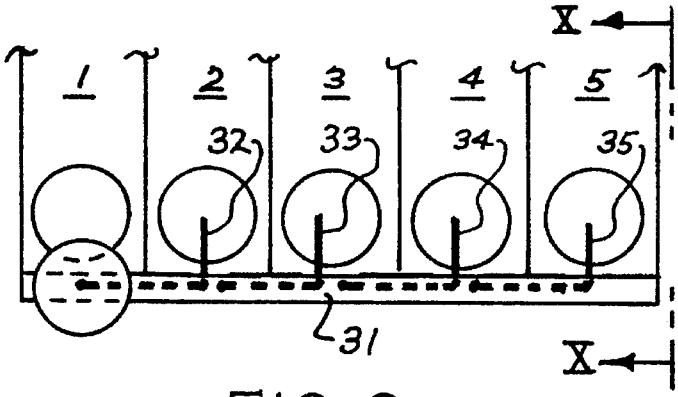
FIG. 9 is an elevation view taken along IX—IX to show the lane blockers.
Figure 10:
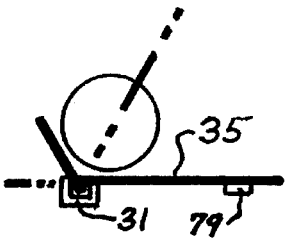
FIG. 10 is a side elevation view taken along X—X of the lane blockers.

Lane blockers 32, 33, 34, and 35 shown in FIGS. 2 & 3, are designed so balls will only be allowed to exit from one lane at a time and prevent clogging. The blockers are contained in slots 56, 57, 58, 59 and 60 in floor 36. A lane blocker is constructed of a one-piece, heavy stiff wire consisting of a center horizontal component, a short end component, a long end component having the end components at an oblique angle to each other and the end components at right angles to the center component. Referring to 35, the long end sits down in slot 59 (the slot is right through floor 36) and rests on member 79 (shown only in FIGS. 1 & 10) which is attached to base 6C and runs the complete width of floor 36. The center component of 35 sits in channel 31 which is attached to the complete width of floor 36 as shown in FIGS. 1, 9, & 10 (31 is not shown in FIG. 2 for clarity purposes). The short end of 35 projects up in slot 60 in a near vertical and at an oblique angle to the long end as seen in FIG. 10. The lane blocker is loosely maintained sitting in channel 31 and free to rotate but unable to get out of the channel since it is under the hopper floor and cannot move sideways appreciably because it is captured in the slots. In FIG. 8 the theory of the lane blocker can be explained. Balls are sitting on top of the long end of 35 and due to their weight the blocker cannot rotate and therefore the short end will block ball 71 and all the balls in the lane behind ball 71. As the balls come off the long end, one by one, eventually the last ball 70 will be off the wire and since there then is no weight on the long end, ball 71 will rotate the wire and run over the short end as shown with the wire in the alternate position in FIGS. 8 & 10. In FIG. 10, the short end will rotate down (slots are cut in 31 to allow this) until it hits the bottom of the channel as shown in the alternate position and when all the balls in the lane have rolled off the short end, the lane blocker will rotate back to its original position automatically (with the long end resting on 79) due to the greater weight of the long end and the oblique angle between the ends.

Figure 11:
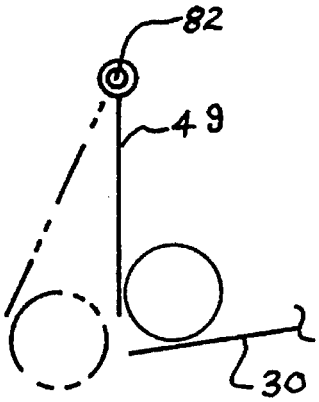
FIG. 11 is a side elevation view taken along XI—XI of the one-way gates.

Items 49, 50, 51 & 52 in FIGS. 2, 3 & 11 are one-way swinging gates of clear plastic which only open towards the hopper exit 83 and entrance to tube 28. Gate 49 is parallel to partition 44 and cannot swing into lane 2 since it would hit partition 44 (for clarity FIG. 3 does not show 49 extending this far). Gates 50, 51 & 52 are on an angle to guide the balls to the exit and they cannot swing away from the exit because they would hit wall 40. FIG. 11 shows the operation of a one-way swinging gate. A ball rolling down ramp 30 will just push gate 49 out of the way into the alternate position shown since the gate is very light compared to the ball. Each gate can pivot about a bolt like 82 which is attached between wall 40 and the appropriate partition (for clarity, bolts 82 are not shown in other views).

The top floor 38 of the hopper is sloped between ⅜ inch drop to 1¼ inch drop in 8 inches of run. With ref. to FIG. 1, if the slope is greater than noted, as the balls emptied out of the bottom floor one at a time, balls 74, 75 & 76 would move along the top floor 38 in their same relative positions and when ball 75 would touch wall 37 it would still be on top of ball 76 and balls 75 & 76 would jam and stop and also hold up all the balls coming behind them. However if the slope is between ⅜ to 1¼ inch drop in 8 inches of run when ball 74 moves the distance of one ball ahead, ball 75 will drop down in line behind 74 and as a result whenever they meet wall 37, no balls will be on top of each other and no jamming will occur. This happens since with the gentler slope, ball 75 now has more force vertically down than the force of ball 76 along the slope and ball 75 will force its way in front of ball 76.

To hold more balls, the hopper could be made with more floors in height and/or more lanes in width. The size is only limited by the practicality of the unit, ie, what is the maximum size and weight for easy portability, and/or how many golf balls you want to hit before stopping to reload the hopper. The hopper can be made with only a bottom floor or a bottom floor and a top floor or a bottom floor and a top floor and one or more intermediate floors. In any case, the bottom floor would be the same design (but wider if more lanes are used) and the top floor would be the same slope as before and any intermediate floors would just have to have enough slope to get the balls rolling since they would only have one height of balls.

A clear plastic tube ramp 8 transmits the balls from tube 28 to the tee. It is slightly greater in diameter than a golf ball and can pivot around bolt 17 which is fastened between two base supports 6B as shown in FIG. 1. A rectangular opening 13 in the top half of the tube allows a ball to enter out of tube 28. A circular opening 16 on the bottom of 8 near the end is of sufficient size to allow a ball 15 out onto tee 9. Counterweight 73 maintains 8 in its near vertical position (alternate shown) until a ball enters 13, pivoting 8 until it hits stop 14 (which is adjustable) giving 8 a slope towards tee 9.

Figure 5:
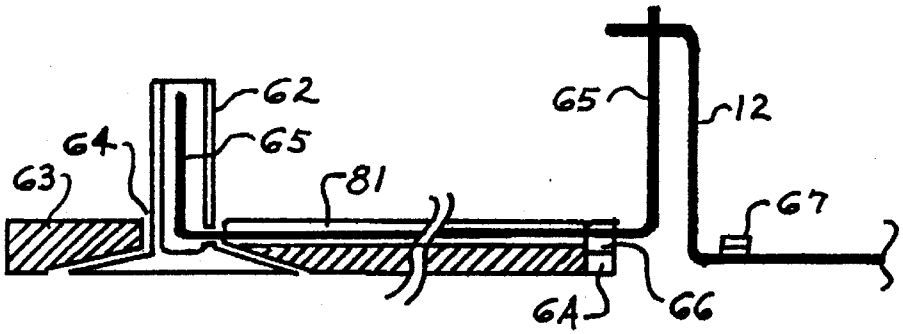
FIG. 5 shows a sectional elevation of an alternate construction for the tee pad and actuation means to release the ball.

In FIG. 5, an alternate arrangement is shown for the tee pad and actuation means for the ball release. Tee 62 protrudes through opening 64 in rubber tee pad 63. A one-piece rotatable wire lever 65 protrudes up in the center of the tee to just below the top of the tee. The horizontal component of 65 is in a groove 81 in the pad and is held loosely in opening 66 of base 6A and has a vertical component at the end contained in the loop of transfer lever 12. To operate the automatic golf tee device, it is carried, say from your car trunk, by a light rope handle (not shown), out on the driving range and placed on a fairly level spot on the driving range mat area or preferably on a grass area where the golfer has better grip with his golf shoes. Balls are now placed in the hopper and they have to be loaded in a prescribed sequence which is lane 1 first, followed in order by lane 2, lane 3, lane 4 and last lane 5. Balls placed in the top floor of lane 1 will run down to the bottom floor of lane 1 and into stationary tube 28 and the first ball down will hit the vertical blade of rotor 25 and will try to turn the rotor but the bottom blade will be against the pendulum wheel 24 and will not allow the rotor to turn and therefore the first ball has been captured. The balls will continue to fill up tube 28 and will even try to force themselves up ramp 30 but will be prevented from entering the ramp by gate 49 which will hit wall 44. Once balls have filled lane 1 bottom floor (one ball high), the long end of blocker 32 is completely covered and the blocker cannot rotate. Balls can now be put in the top floor of lane 2 and they will run down to the bottom floor where the first ball down will be stopped by the short end of blocker 32. At the same time, the balls now in the bottom floor of lane 2 have covered the long end of blocker 33 which will prevent any balls from coming out of lane 3 since the short end of 33 cannot rotate. Balls are now placed in lanes 3, 4 & 5 in that sequence and with the bottom floors filled, blockers 34 & 35 are brought into effect. The top floors of the hopper can now be filled in any order since all blockers are now holding. Balls can be piled two high on the top floor but balls cannot be piled on top of the first two balls at the entrance to the bottom floor, namely balls 77 & 78, since clogging would result as balls on top of 77 & 78 would not have enough distance to drop down in line before they would reach wall 37. A third height of balls can be piled on the top floor but accordingly they must not touch the first ball of the second height namely 75. Although this seems like a complicated loading arrangement, it can actually be done in just a few minutes. It just has to be remembered to first fill the bottom floor of lanes 1, 2, 3, 4, & 5 in sequence.

With the hopper loaded, you are now ready to hit balls and you may find that the first ball is already on the tee 9 (this will depend on what position the rotor was in after carrying the device and setting it down). If the rotor blades are at 90 degrees and parallel to the ground, a blade will be resting against the pendulum wheel 24 stopping the rotor from turning and capturing the first ball down and therefore a ball will not be on the tee to start but it is only necessary to take a practice swing brushing the top of the tee and the first ball will come out onto the tee. However if the rotor blades were at about 45 degrees to the ground, the first ball down tube 28 will run right through the rotor onto the tee but at the same time it will rotate the rotor to 90 degrees and the second ball down tube 28 will be captured.

With ball 15 on the tee, pivoting ramp 8 will now be in its near vertical position and tee pad 7 will be clear for the golfer to swing. The golfer will swing his club hitting ball 15 which will bend tee 9 and in so doing will rotate the tee and also rod 10 as shown in FIG. 6. A proper swing will have the club clipping the top of the tee however the device will still operate properly if only the ball is contacted since rod 10 and lever 12 are contained loosely and are very sensitive to any little movement. The golf club swing has a great force and therefore every thing it comes in contact with must be built accordingly. With ref. to FIG. 1, the golf club cannot hit rod 10 nor bolts 61 in FIGS. 4 & 7 since they are below the top surface of rubber tee pad 7 and are protected by the pad. If the golf club hits the pad, the club will just bounce off like on any driving range mat. If the golfer accidentally hits straight down on the top of tee 9, the edges of the tee base will bend, rod 10 will hit the ground but will not bend since it has a loose fit in opening 66 in FIG. 4 and no damage will occur. In FIG. 4, the right-handed golfer hitting tee 9 will cause rod 10 to rotate counterclockwise nearly 45 degrees also making lever 12 rotate the same which will oscillate pendulum 23 in a clockwise direction and wheel 24 will roll off the blade of rotor 25. With the wheel off the rotor, the downward force of the balls in tube 28 will rotate the rotor and let a ball out of tube 28. In the meantime in FIG. 2, alternate position, the bottom of pendulum 23 will hit base 6 and bounce back quickly to the vertical helped by conterweight 19. This happens so quickly that the pendulum is back vertical in time to interfere with the next blade of the rotor preventing the rotor from turning and not allowing another ball out. With ref. to FIG. 6, the tee only rotates about 45 degrees due to the resistance of shoulder 69A however the other side of the tee base is allowed to lift up off shoulder 69B. Allowing the base to lift off shoulder 69B, gives less resistance to the tee rotating member and actually will improve the life of the tee. Due to the elasticity of the tee base, the resistance of shoulder 69A will bring the tee back to vertical immediately. The rebound of the pendulum back off the base is dampened by the tee base returning to shoulder 69B. The hitting of the tee and the tee returning to its upright position happens instantaneously (less than one second).

In FIG. 1, ball 29 having been let out of tube 28 will fall into opening 13 and the velocity and weight of the ball will cause ramp 8 to pivot counterclockwise until it hits stop 14 adjusted to give a slight slope down to the tee & ball 29 will fall out opening 16 onto tee 9 which is now back to its normal vertical position. From the time ball 15 was hit until ball 29 was put on the tee, less than 4 seconds had elapsed. When ball 29 was released by the rotor, every ball in lane 1 moved along the distance of one ball diameter. The balls in the other four lanes did not move. A ball will not start moving out of lane 2 until the last ball is off the long end of blocker 32 and then the first ball in lane 2 will rotate the short end of blocker 32 down and run over this end and be guided towards tube 28 by gate 50 and as it moves along it will also swing open gate 49 as in FIG. 11. Similarly, balls will empty out of lanes 3, 4 & 5 in succession. Balls proceeding down ramp 30 will swing open every gate they come in contact with on their way to tube 28. For instance, a ball coming out of lane 5 would swing open gates 52, 51, 50 & 49 to get to tube 28.

In the alternate arrangement shown in FIG. 5, the tee is held in place by being under the tee pad and the base of the tee does not move. When the golfer hits the top of the tee it will bend rotating lever 65 which will then rotate transfer lever 12 and events will happen as described previously.

Although the invention has been described with respect to a preferred embodiment thereof, it is to be understood that it is not to be so limited since changes and modifications can be made therein which are within the full intended scope of this invention as defined by the appended claims.

What I claim is:

1. A golf ball teeing device comprising a base, a hopper for holding a plurality of balls connected to the base by vertical projections, a means for transmitting the balls from the hopper to a tee consisting of a sloped stationary tube attached to a hopper exit and to the vertical base projections allowing balls to run down the tube and fall into a pivoting tube attached to the vertical base projections which pivots due to the weight of the ball and the ball falls onto the tee, a means for releasing one ball at a time from the stationary tube which consists of a rotor attached to the vertical base projections and a pendulum having a component above and below a pivot point! which is attached to the vertical base projections, a means for actuation for the ball release means attached to the tee which is rotatable and contacts the pendulum and an above ground thin tee pad attached to the base with means for holding the tee and holding the actuation means for the ball release means.

2. A golf ball teeing device as claimed in claim 1, wherein the hopper consists of partitions forming lanes to keep the balls in single file with each lane having a bottom floor and a top floor where balls can be piled two and three balls in height with the bottom floor having lane blockers allowing balls out of only one lane at a time with the lane blocker constructed of a one-piece, heavy, stiff, rotatable wire having a horizontal center component, a short end component and a long end component with the end components at an oblique angle to each other and the end components at right angles to the center component.

3. A golf ball teeing device as claimed in claim 2, wherein the hopper contains one-way swinging gates which only open towards the hopper exit.

4. A golf ball teeing device as claimed in claim 3, wherein the hopper top floor has a slope between ⅜ inch drop to 1¼ inch drop in 8 inches of run so that balls piled two balls high will let balls on the second height drop down to the first height before moving down the slope.

5. A golf ball teeing device as claimed in claim 1, wherein the means for actuation for the ball release means consists of a rotatable member having a horizontal component with a vertical rubber tee fastened to the horizontal component near one end and a solid vertical component fastened to the horizontal component near the other end which contacts a rotatable lever constructed of a one-piece, heavy, stiff wire with a horizontal center component and a vertical component at each end.

* * * * *